United States Patent [19]

Sautter

[11] 4,006,821

[45] Feb. 8, 1977

[54] MULTI-TRAY CONTAINER FOR STORING ELONGATE OBJECTS

[75] Inventor: Karl Sautter, Ammerbuch-Reusten, Germany

[73] Assignee: Georg Knoblauch Werkzeugkassetten-fabrik, Giengen, Germany

[22] Filed: Dec. 29, 1975

[21] Appl. No.: 645,013

[30] Foreign Application Priority Data

Dec. 28, 1974 Germany ..... 2461766

[52] U.S. Cl. ..... 206/379; 190/17; 206/45.13; 206/45.15; 312/270; 312/DIG. 33

[51] Int. Cl.[2] ..... B65D 85/29

[58] Field of Search ..... 312/DIG. 33, 269, 270, 312/271, 272, 272.5, 275; 206/379, 380, 382, 45.13, 45.18; 190/17

[56] References Cited

UNITED STATES PATENTS

| | | | |
|---|---|---|---|
| 490,156 | 1/1893 | Miller | 206/745 |
| 2,269,637 | 1/1942 | Polkosnik | 206/379 |
| 2,430,707 | 11/1947 | Cahn | 206/45.13 |
| 2,504,479 | 4/1950 | Wilhoite et al. | 190/17 |
| 2,512,747 | 6/1950 | Lewis | 312/269 |
| 2,775,342 | 12/1956 | Smith | 206/45.13 |
| 3,018,876 | 1/1962 | Huot | 206/379 |
| 3,074,539 | 1/1963 | Rogovin | 206/379 |
| 3,086,645 | 4/1963 | Yount | 206/45.13 |

FOREIGN PATENTS OR APPLICATIONS

| | | | |
|---|---|---|---|
| 9,813 | 5/1892 | United Kingdom | 206/45.13 |
| 850,798 | 10/1960 | United Kingdom | 206/379 |

*Primary Examiner*—George E. Lowrance
*Assistant Examiner*—Bruce H. Bernstein
*Attorney, Agent, or Firm*—Lawrence E. Laubscher

[57] ABSTRACT

A container is disclosed for storing a plurality of elongated objects such as drill bits, screw taps and the like, including a body member, and a plurality of object-storing trays pivotally connected at one end with said body member for pivotal movement about a common pivot axis. The trays are automatically displaced from stacked retracted positions within the body member toward extended positions in which the other ends of the trays extend outwardly from the body member in accordance with the movement of a lid member that is pivotally connected with the body member.

7 Claims, 5 Drawing Figures

MULTI-TRAY CONTAINER FOR STORING ELONGATE OBJECTS

BRIEF DESCRIPTION OF THE PRIOR ART

Various types of containers have been proposed in the patented prior art for storing elongated objects, such as drill bits, screw taps and the like. One example of such a container is disclosed in the Metzler U.S. Pat. No. 3,904,035 (which is assigned to the same assignee as the present invention). In this prior patent, opening of a pair of pivotally connected cover members causes automatic displacement of a tool-storing tray from a retracted position to an extended position relative to the container body.

It is also known in the prior art to provide a container including a body member within which are pivotally connected by separate pivot axes a plurality of stacked tool-storing trays. The uppermost tray may be connected for displacement from a retracted position to an extended position by a cover member that is pivotally connected with the container body member. Such a construction is relatively complex and difficult to manufacture.

SUMMARY OF THE INVENTION

The present invention relates to an improved container for elongated objects in which a plurality of storage trays pivotally connected at one end with a body member by a common pivot axis are automatically displaced from stacked retracted positions in the body member toward extended positions in which the ends of the trays protrude from the body member as a lid member is pivoted from a closed position toward an open position relative to the body member. Consequently, the positioning of the pivotal trays in the container and their mutual operation between the retracted and extended positions are greatly simplified, thereby resulting in a considerable reduction in cost.

Accordingly, a primary object of the present invention is to provide a container including pivotally connected body and lid members, a plurality of tool-storing trays pivotally connected at one end within the container for pivotal movement about a common pivot axis between stacked retracted and extended positions relative to the container body, means connecting the lid member to one tray for pivoting that tray toward its extended position when the lid is pivoted toward its open position, and abutment means for simultaneously pivoting the remaining tray (or trays) toward the extended position as the first tray is moved toward its extended position by the lid member. By having the trays connected for pivotal movement about a common pivot axis, the manufacture of the container is greatly simplified, and the trays can be pivoted simultaneously toward their extended positions without the necessity of separate coupling members between the trays.

According to a more specific object of the invention, the top tray of the stack is connected with the lid and the pivot axis passes through the side walls of the next tray. The first tray is connected with the pivot axis by pivot arms that extend downwardly from the bottom wall of the first tray, said pivot arms carrying abutment surfaces that engage the upper surface of the bottom wall of the second tray to pivot the second tray toward the extended position as the first tray is pivoted toward the extended position by the lid member.

In accordance with another object of the invention, a third tray arranged beneath the second tray is connected by pivot arms to the pivot axis, said third tray having upwardly extended projection means that carry at their extremities abutment surfaces which are engaged by the lower surface of the bottom wall of the second tray when this second tray is pivoted toward its extended position, thereby causing the third tray to be pivoted toward its extended position.

A further object of the invention is to provide a container of the type described above wherein all of the trays are simultaneously returned to their retracted positions as the lid is pivoted to its closed position relative to the container body member.

DETAILED DESCRIPTION OF THE FIGURES

Other objects and advantages of the invention will become apparent from a study of the following specification when viewed in the light of the accompanying drawings, in which.

DETAILED DESCRIPTION

Figure 1:
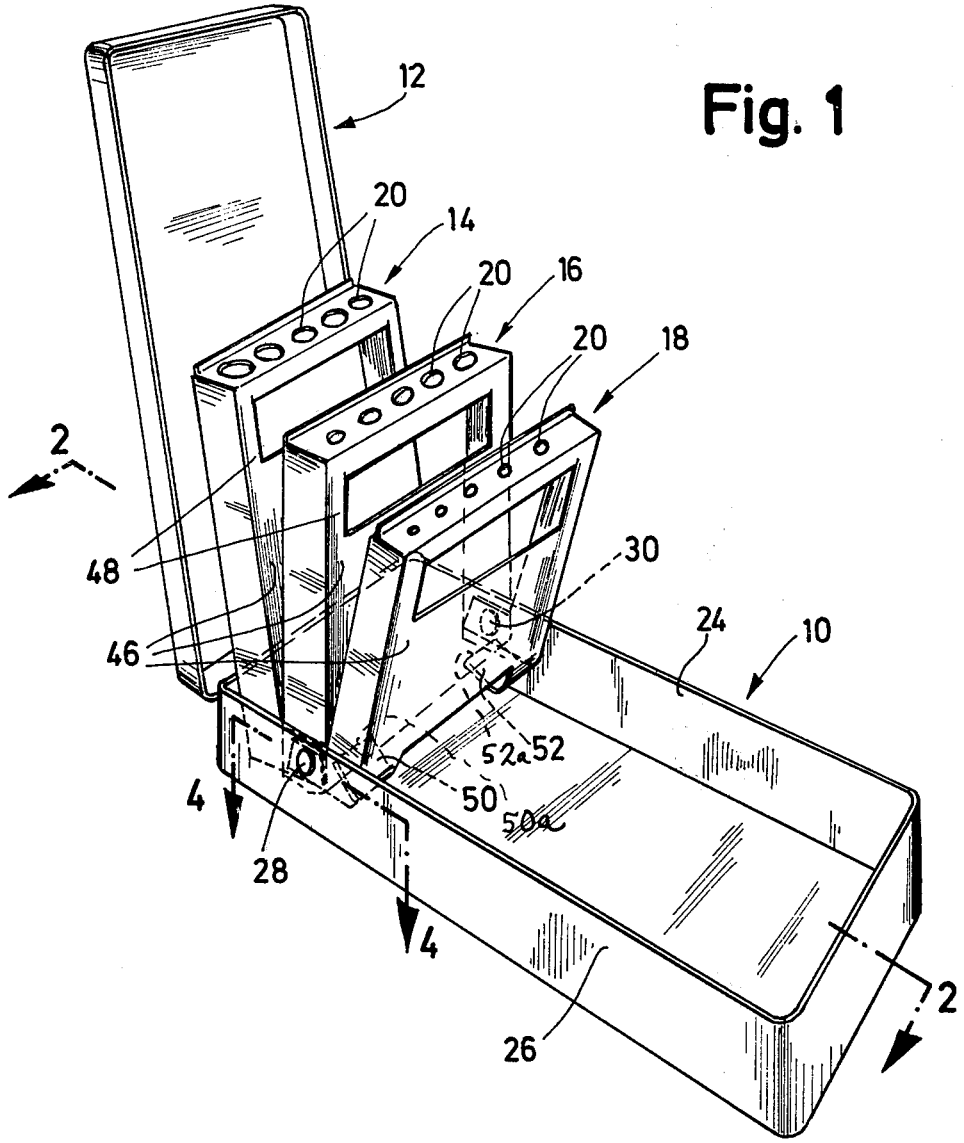
FIG. 1 is a perspective view of a first embodiment of the invention, illustrating the lid member in the open position and the trays pivoted toward their extended positions.

Referring now to FIG. 1, the container is adapted to store elongated objects such as drill bits, screw taps or the like of progressive diameters. The container includes a tray-shaped body member 10 including a bottom wall, a pair of vertical side walls 24 and 26, and a pair of end walls. Pivotally connected at one end with one end wall is a lid member 12 that is pivotable between a closed position (FIG. 3) and the open position illustrated in FIG. 1.

In accordance with the present invention, a plurality of tool-storage trays 14, 16 and 18 are provided that are pivotally connected at one end with the container body 10 for movement about a common pivot axis parallel with the bottom wall of the body member 10. At their other ends, the trays are provided with end walls that contain graduated openings 20 for receiving tools of different diameters as shown in phantom in FIGS. 2 and 3. These trays are, in accordance with the present invention, simultaneously pivotable by the lid 12 from the stacked retracted position within the container body illustrated in FIG. 3 to the extended position illustrated in FIGS. 1 and 2.

Figure 2:
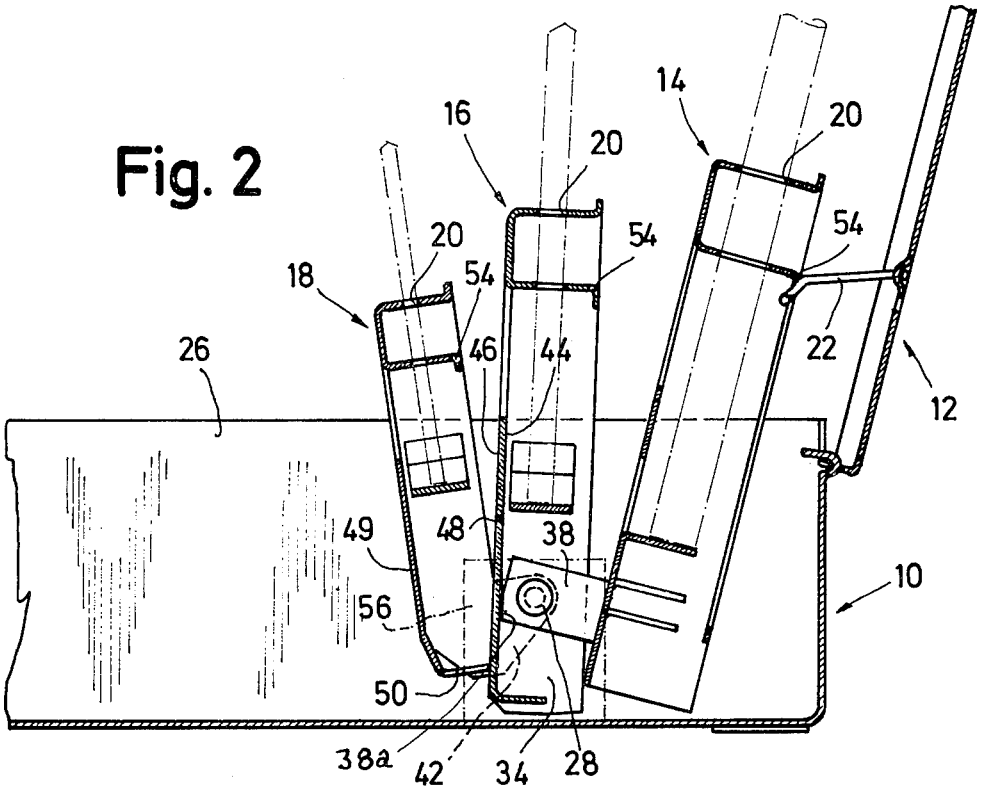
FIG. 2 is a sectional view taken along line 2—2 of FIG. 1.
Figure 3:
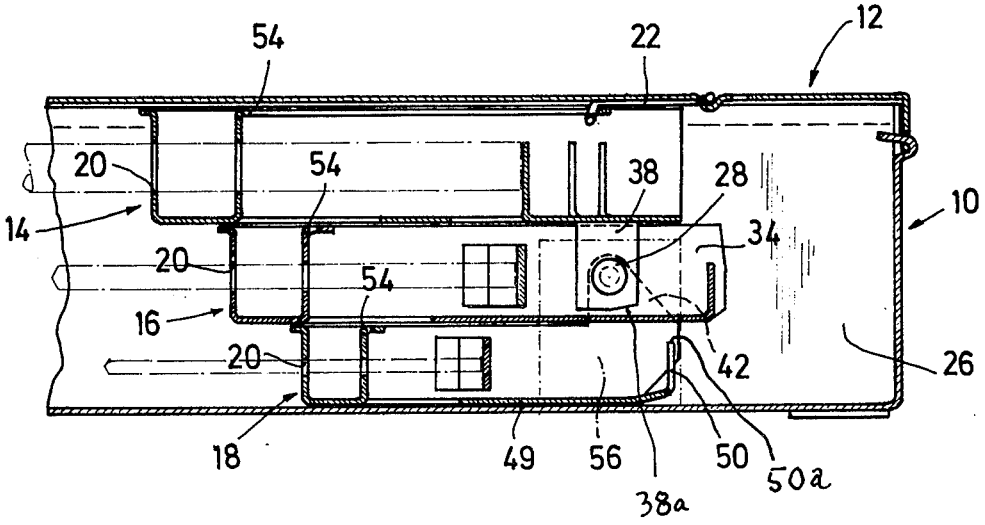
FIG. 3 is a sectional view corresponding to FIG. 2 wherein the lid member is closed and the trays are in their stacked retracted positions.
Figure 4:
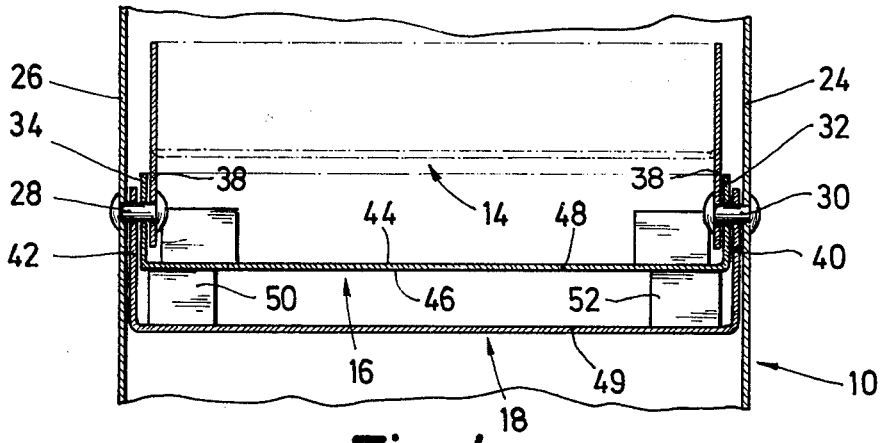
FIG. 4 is a detailed sectional view taken along line 4—4 of FIG. 1.

The horizontal pivot axis for the trays 14, 16 and 18, which is also parallel with the pivot axis of the lid 12 as shown in FIG. 2, is defined by a pair of rivets 28 and 30 as shown in FIG. 4. More particularly, in the embodiment of FIGS. 1–4 the rivets 28 and 30 pass through aligned openings contained in the side walls 32 and 34 of the tray 16. The top tray 14 is pivotally connected with the horizontal pivot axis by means of pivot arms 38 that extend downwardly from the bottom wall of the tray 14. As shown in FIG. 2, the tray 14 is connected with the lid 12 by connecting means 22, one end of which is pivotally connected with the lid 12 and the other end of which extends through an opening 54 contained in the tray 14. The bottom tray 18 is pivotally connected with the horizontal pivot axis defined by rivets 28 and 30 by means of pivot arms 40 and 42 that extend upwardly from the tray as shown in FIGS. 3 and 4.

In accordance with the present invention, means are provided for automatically pivoting the second and third trays 16 and 18 upwardly toward their extended positions simultaneously with the pivotal movement of tray 14 toward the extended position by the lid member 12. Referring to FIG. 2, it will be seen that the lower extremities 38*a* of the pivot arms 36 and 38 of the top tray 14 define abutment surfaces adapted to engage the upper surface 44 of the bottom wall 48 of the second tray 16. Thus, as the top tray 14 is pivoted from its retracted (FIG. 3) position toward its extended (FIG. 2) position, the abutment surfaces 38*a* engage the bottom wall 48 of the second tray 16 to pivot this tray 16 toward its extended position. Furthermore, the third tray 18 contains adjacent the horizontal pivot axis vertical projections 50 and 52 having at their upper free extremities abutment surfaces 50*a* and 52*a* that are adapted to be engaged by the bottom surface 46 of the bottom wall 48 of the second tray 16. Consequently, when the second tray 16 is pivoted upwardly by the abutment surfaces 38*a* associated with the top tray 14, the bottom surface 46 of the second tray 16 engages the abutment surfaces 50*a* and 52*a* on the third tray 18 to effect pivotal movement of the third tray 18 from its retracted (FIG. 3) position toward its extended (FIG. 2) position. Preferably the abutment surfaces 36*a*, 38*a*, 50*a*, and 52*a* are so arranged that when the trays are in their extended (FIG. 2) position, the trays have a spread fan-shaped orientation, thereby permitting ready access to the various tools stored therein. As shown in FIG. 2, each of the trays is provided with the connecting openings 54 to afford a degree of exchangeability and/or elimination of one or more of the trays, if desired.

Preferably the trays, the container body member, and the lid are each formed from sheet metal, although, if desired, these components may be formed from a suitable synthetic material. In the embodiment of FIGS. 1–4, the container body member 10 is unitary and the rivets 28 and 30 which define the common horizontal pivot axis of the trays extend through aligned openings contained in the side walls 24 and 26 of the container body member 10.

Figure 5:
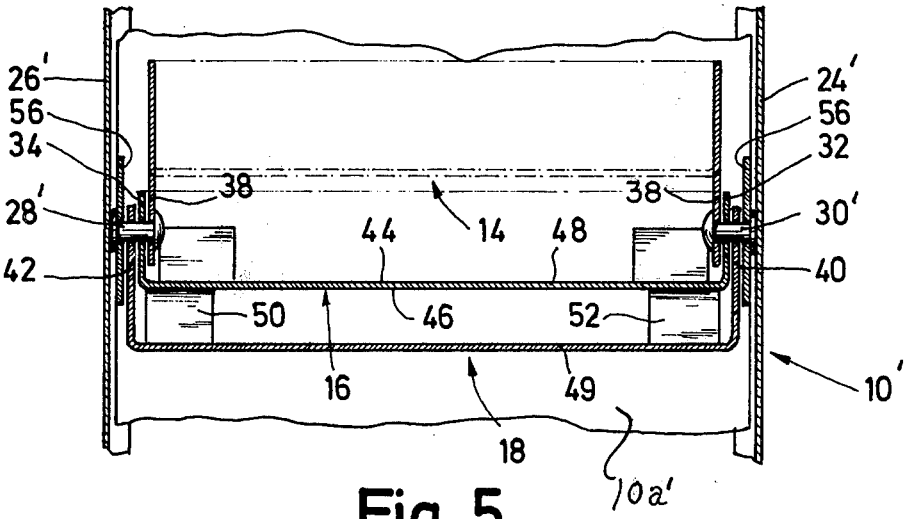
FIG. 5 is a sectional view (corresponding to FIG. 4) of a modification of the invention of FIG. 1.

Referring now to the embodiment of FIG. 5, the container body member 10' includes a bottom wall 10*a'* to the opposite side edges of which are connected upwardly extending lugs 56 as shown in FIG. 5. The rivets 28' and 30' that define the common horizontal pivot axis of the trays are contained in aligned bores that are formed in the container bottom wall lugs 56. The container bottom wall 10*a'* is secured within a rectangular frame which defines the body side walls 24' and 26', and the end walls (not shown).

While in accordance with the provisions of the Patent Statutes, the preferred form and embodiments of the invention have been illustrated and described, and it will be apparent to those skilled in the art that various modification may be made without deviating from the invention disclosed above.

What is claimed is:

1. A container for storing a plurality of elongated objects, such as drill bits, screw taps and the like, comprising a. an open-topped body member (10) having a horizontal bottom wall and vertical side and end walls;

b. a lid member (12) pivotally connected with said body member for pivotal movement between closed and open positions relative thereto;

c. at least two trays (14, 16, 18);

d. pivot means (28) pivotally connecting said trays at one end with said body member for pivotal movement about a common pivot axis parallel with both said body bottom wall and the pivot axis of said lid member, said trays being pivotally displaceable between stacked retracted positions within said body member and extended positions in which the other ends of said trays extend through the top of said body member;

e. connecting means (22) connecting said lid with a first one (14) of said trays to cause said first tray to be displaced toward its extended position when the lid is pivoted toward the open position relative to said body member; and f. abutment means (38*a*, 38*a*; 50*a*, 52*a*) adjacent one end of one of said trays for causing the other tray to be displaced toward its extended position when said first tray is displaced by said lid toward its extended position, said trays being returned to their retracted positions when the lid is pivoted to the closed position relative to the body member, said abutment means comprising at least one abutment surface arranged on one of said trays adjacent said common pivot axis for cooperation with a corresponding surface on the other of said trays.

2. Apparatus as defined in claim 1, wherein each of said trays includes at said other end an end wall containing openings (20) for receiving the elongated objects.

3. Apparatus as defined in claim 1, wherein said first tray (14) is the top tray of the stack, and further wherein the other tray (16) of the stack has bottom (48) and side (32, 34) walls, the pivot axis of said trays extending through the side walls of said second tray, said first tray being pivotally connected with said pivot axis by pivot arms (36, 38) that extend downwardly from the bottom wall of said first tray, said abutment means comprising integral abutment surfaces (36*a*, 38*a*) defined by the lower extremities of said pivot arms that are operable, when said first tray is pivoted by the lid to the extended position, to engage the upper surface (44) of said other tray to pivot said other tray toward its extended position.

4. Apparatus as defined in claim 3, and further including a third tray (18) arranged beneath said second tray, said third tray having upwardly extending pivot arms (40, 42) for pivotally connecting said third tray to said pivot axis, said abutment means comprising upwardly extending projection means (50, 52) at said one end of said third tray the extremities of which are arranged for engagement by the lower surface (46) of the bottom wall (48) of said second tray, when said second tray is pivoted toward its extended position, to pivot said third tray toward its extended position.

5. Apparatus as defined in claim 4, wherein said abutment means are so designed to cause said pivotally connected trays, when in the extended position, to be slightly spread apart in fan-type relation.

6. Apparatus as defined in claim 1, wherein said body member bottom wall includes at its opposite longitudinal edges a pair of integral opposed upwardly extending extensions (56), respectively, and pivot shaft means (28, 30) carried by said bottom wall extensions and about which each of said trays is pivoted.

7. Apparatus as defined in claim 6 wherein said body member further includes an end and side wall assembly connected with said body bottom wall.

* * * * *